US011179296B2

(12) United States Patent
Kawamura

(10) Patent No.: US 11,179,296 B2
(45) Date of Patent: Nov. 23, 2021

(54) CONTAINER HOLDING MEMBER AND MEDICAL CONTAINER SET

(71) Applicant: DAIKYO SEIKO, LTD., Tochigi (JP)

(72) Inventor: Hideaki Kawamura, Tochigi (JP)

(73) Assignee: Daikyo Seiko, Ltd., Tochigi (JP)

( * ) Notice: Subject to any disclaimer, the term of this patent is extended or adjusted under 35 U.S.C. 154(b) by 9 days.

(21) Appl. No.: 15/751,034

(22) PCT Filed: Aug. 31, 2016

(86) PCT No.: PCT/JP2016/075510
§ 371 (c)(1),
(2) Date: Feb. 7, 2018

(87) PCT Pub. No.: WO2017/038878
PCT Pub. Date: Mar. 9, 2017

(65) Prior Publication Data

US 2018/0235838 A1 Aug. 23, 2018

(30) Foreign Application Priority Data

Sep. 4, 2015 (JP) ..... JP2015-174900

(51) Int. Cl.
*A61J 1/16* (2006.01)
*A61J 1/06* (2006.01)
(Continued)

(52) U.S. Cl.
CPC . *A61J 1/16* (2013.01); *A61J 1/06* (2013.01); *B01L 3/50855* (2013.01); *B01L 9/06* (2013.01);
(Continued)

(58) Field of Classification Search
CPC .. F26B 25/06; B01L 2200/18; B01L 3/50855; B65D 1/36; A61J 1/16
(Continued)

(56) References Cited

U.S. PATENT DOCUMENTS 3,441,173 A * 4/1969 Edwards ..... B65D 1/265 206/520
4,684,013 A * 8/1987 Jacobs ..... A01G 9/028 206/423
(Continued)

FOREIGN PATENT DOCUMENTS

EP 0136126 4/1985
EP 1577377 9/2005
(Continued)

OTHER PUBLICATIONS

Extended European Search Report, issued in the corresponding European patent application No. 16841909.3, dated Dec. 21, 2018, 7 pages.
(Continued)

*Primary Examiner* — Anthony D Stashick
*Assistant Examiner* — Raven Collins
(74) *Attorney, Agent, or Firm* — Hamre, Schumann, Mueller & Larson, P.C.

(57) ABSTRACT

The object of the present invention is to provide a container holding member that is capable of simply, surely, and stably holding a plurality of medical containers, and that is usable efficiently for medical containers. The present invention is a container holding member capable of holding a plurality of bottomed tubular medical containers. The container holding member is provided with a flat plate-like substrate section having a plurality of through holes penetrating one surface and the other surface and a plurality of tubular housing sections each having an upper side opening end on a side of the one surface of the substrate section and a lower side opening end on a side of the other surface and each protruding upward or downward from a hole edge of each of the through holes. The tubular housing sections are each configured to be capable of holding each of the medical containers in a state where an outer bottom surface of each of
(Continued)

the medical containers protrudes downward from the lower side opening end when the medical containers are housed in the tubular housing sections.

11 Claims, 11 Drawing Sheets

(51) Int. Cl.
*B01L 3/00* (2006.01)
*B01L 9/06* (2006.01)
*F26B 25/06* (2006.01)

(52) U.S. Cl.
CPC ..... *F26B 25/06* (2013.01); *B01L 2200/025* (2013.01); *B01L 2200/18* (2013.01); *B01L 2300/0609* (2013.01); *B01L 2300/0861* (2013.01)

(58) Field of Classification Search
USPC ..... 206/562
See application file for complete search history.

(56) References Cited

U.S. PATENT DOCUMENTS

| | | | | |
|---|---|---|---|---|
| D533,948 | S * | 12/2006 | Schaub | D24/229 |
| 10,399,768 | B2 * | 9/2019 | Bertolin | B65D 71/70 |
| 10,703,539 | B2 * | 7/2020 | Deutschle | B01L 9/06 |
| 2002/0108917 | A1 | 8/2002 | Maruyama | |
| 2012/0181285 | A1 * | 7/2012 | Krauss | A61J 1/16 220/507 |
| 2013/0161225 | A1 | 6/2013 | Lepot | |
| 2015/0108034 | A1 | 4/2015 | Deutschle et al. | |
| 2015/0122693 | A1 * | 5/2015 | Deutschle | B65D 1/36 206/562 |
| 2015/0166212 | A1 * | 6/2015 | Wissner | B65B 21/18 206/563 |
| 2016/0288126 | A1 * | 10/2016 | Motadel | B01L 9/543 |

FOREIGN PATENT DOCUMENTS

| | | |
|---|---|---|
| EP | 2915516 | 9/2015 |
| JP | 2008-505029 | 2/2008 |
| JP | 2014-238251 | 12/2014 |
| TW | 201447209 | 12/2014 |
| WO | 2011/135085 | 11/2011 |
| WO | 2012/035155 | 3/2012 |
| WO | 2014/069244 | 5/2014 |
| WO | 2016/166765 | 10/2016 |

OTHER PUBLICATIONS

International Search Report, issued in the corresponding PCT application No. PCT/JP2016/075510, dated Nov. 22, 2016, 5 pages.
Indian Examination Report, issued in the corresponding Indian patent application No. 201817005239, dated Jan. 15, 2020, 8 pages (all the cited references in the Office Action were previously cited in the IDS, filed Feb. 7, 2018 and Jan. 15, 2018).
European Communication regarding Third party observations, issued in the corresponding European patent application No. 16841908.3, dated Jul. 24, 2020, 12 pages.
Second Canadian Office Action, issued in the corresponding Canadian patent application No. 2,996,490, dated Mar. 2, 2020, 6 pages.
First Canadian Office Action, issued in the corresponding Canadian patent application No. 2,996,490, dated Feb. 27, 2019, 4 pages, (all references have been cited before).
Korean Office Action, issued in the corresponding Korean patent application No. 10-2018-7008302, dated Jan. 18, 2019, 9 pages, including machine translation, (all references have been cited before).
Third Canadian Office Action, issued in the corresponding Canadian patent application No. 2,996,490, dated Sep. 4, 2020, 6 pages (all references have been previously cited).
European Office Action, issued in the corresponding European patent application No. 16841908.3, dated Nov. 26, 2020, 12 pages (all references have been previously cited).

* cited by examiner

[FIGURE 1]
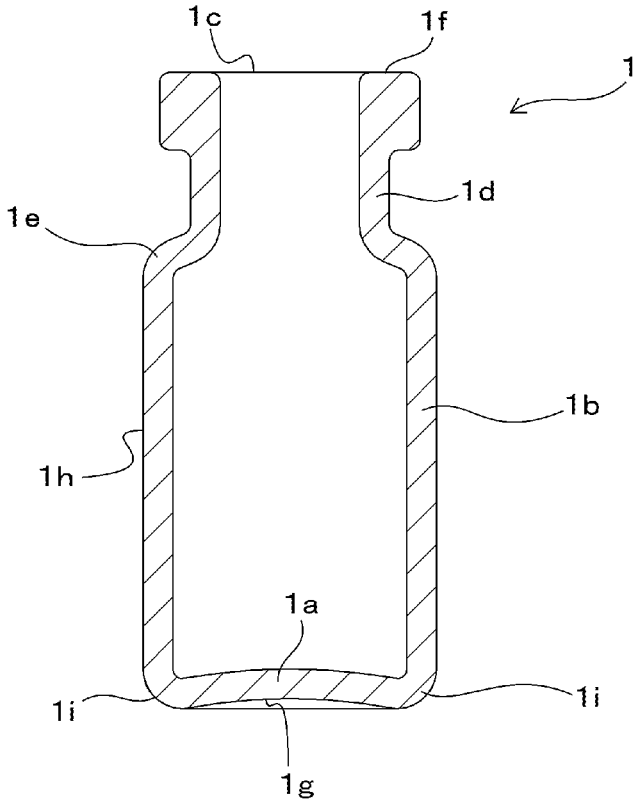

[FIGURE 2]
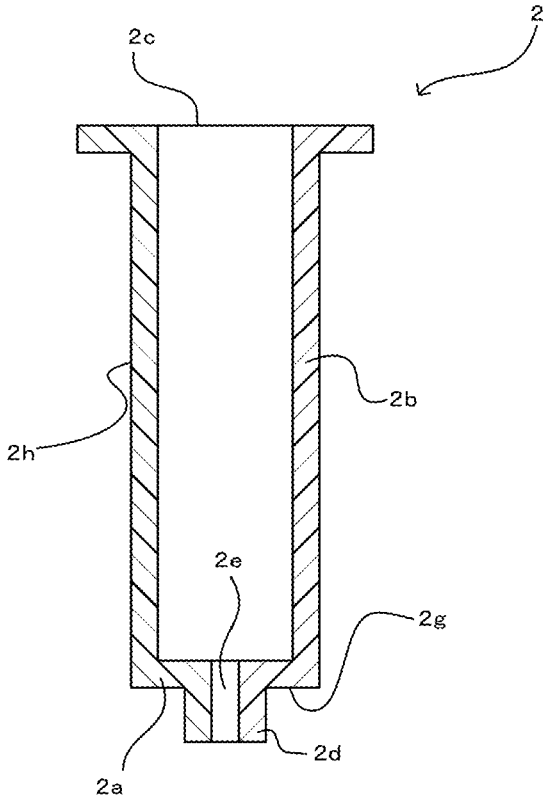

[FIGURE 3]
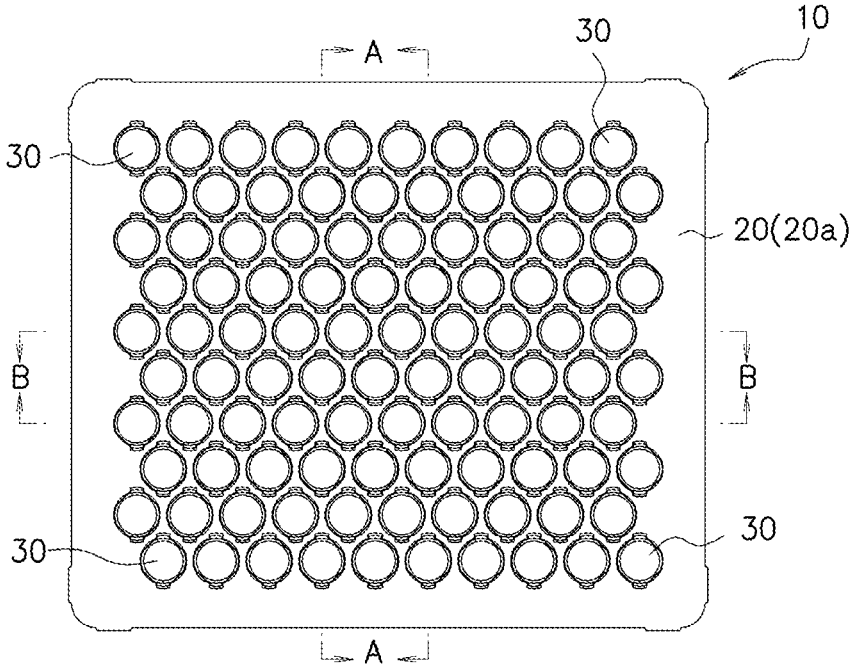
[FIGURE 4]
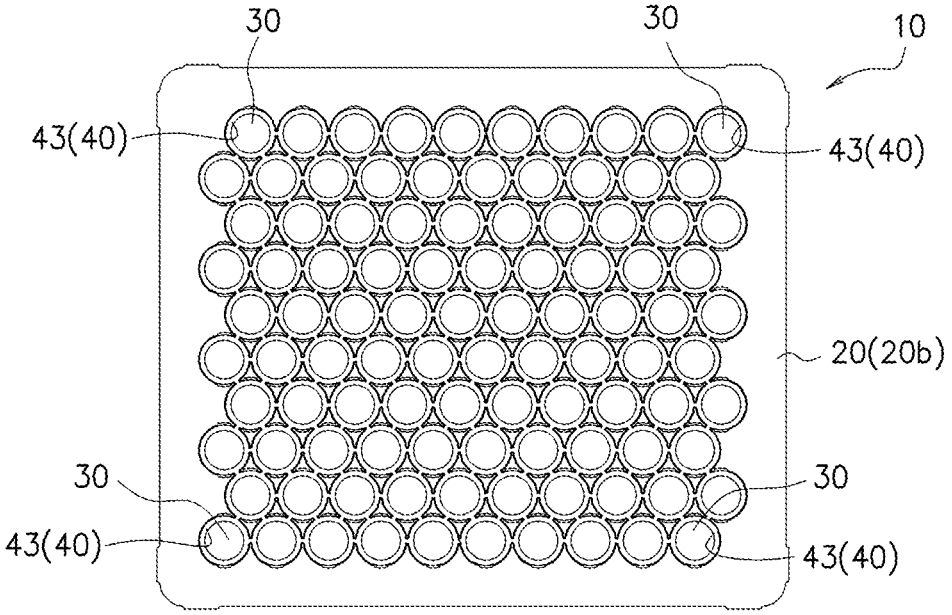

[FIGURE 5]
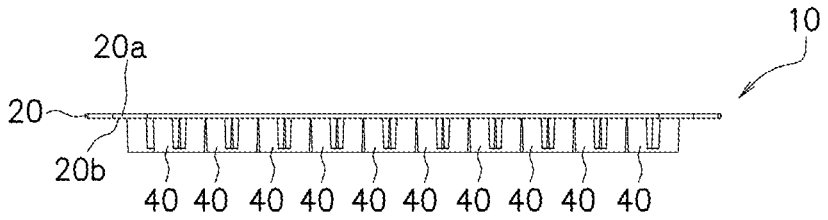
[FIGURE 6]
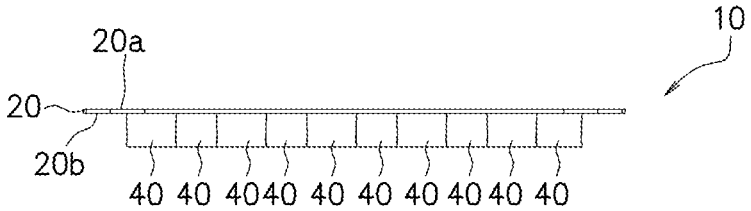
[FIGURE 7]
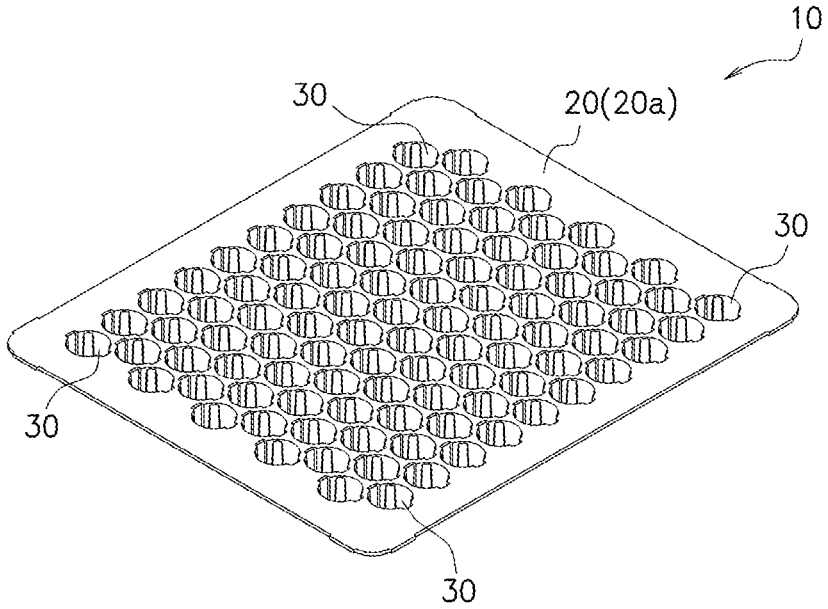

[FIGURE 8]
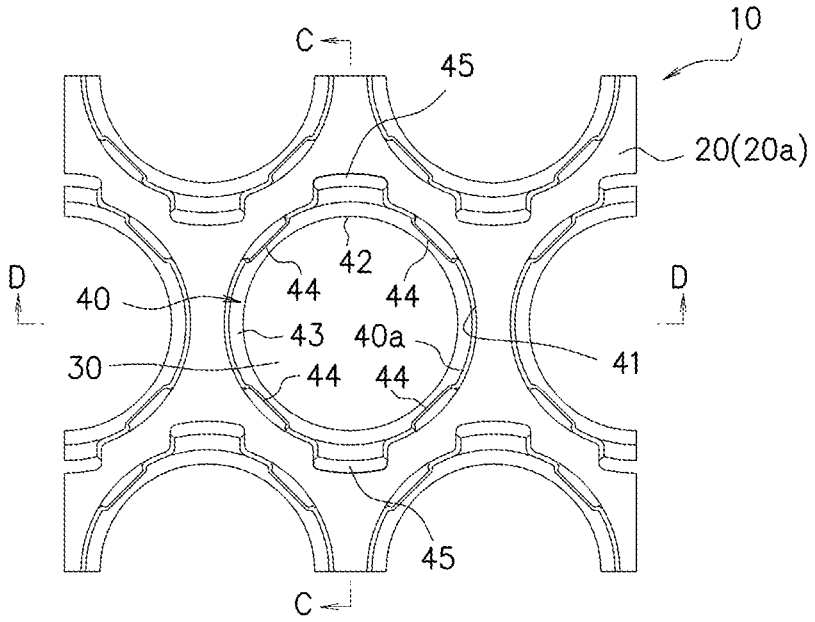
[FIGURE 9]
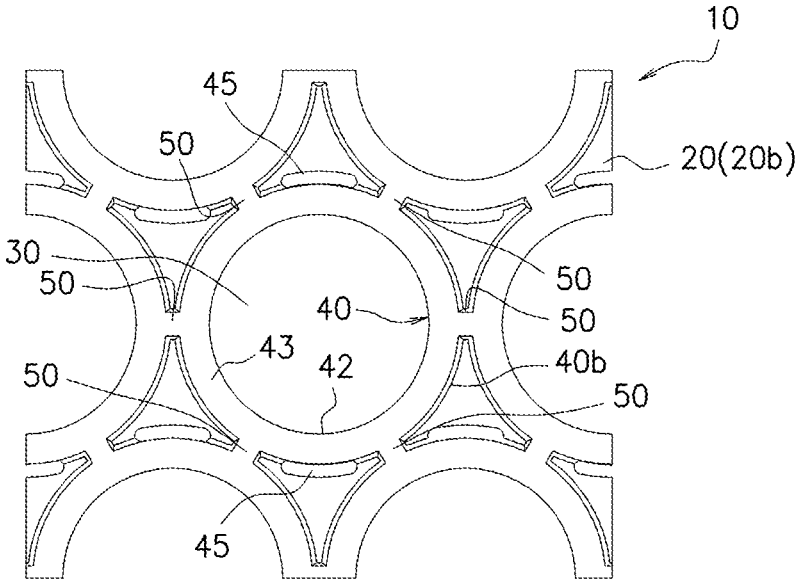

[FIGURE 10]
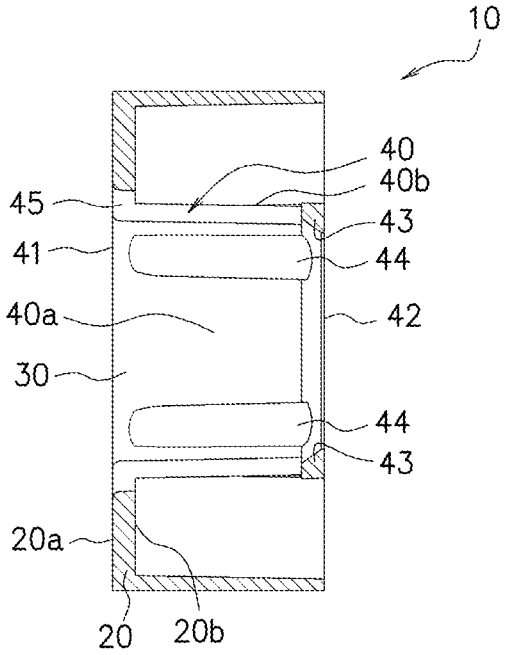
[FIGURE 11]
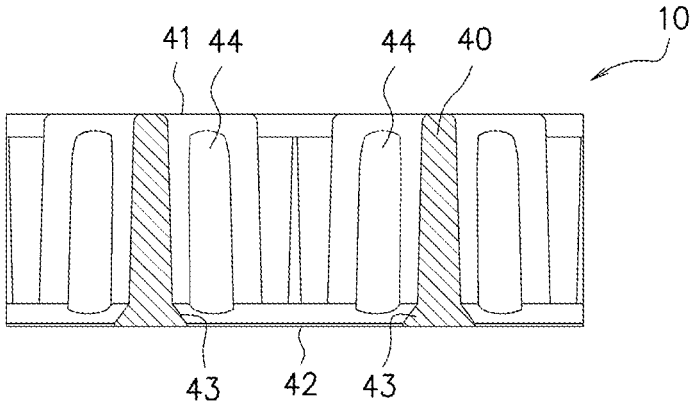

[FIGURE 12]
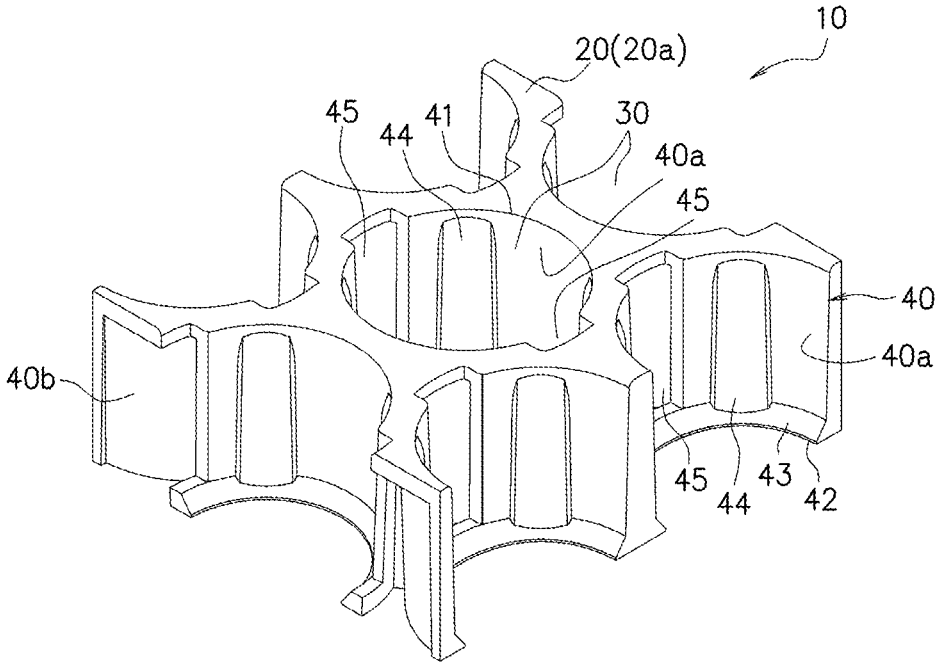
[FIGURE 13]
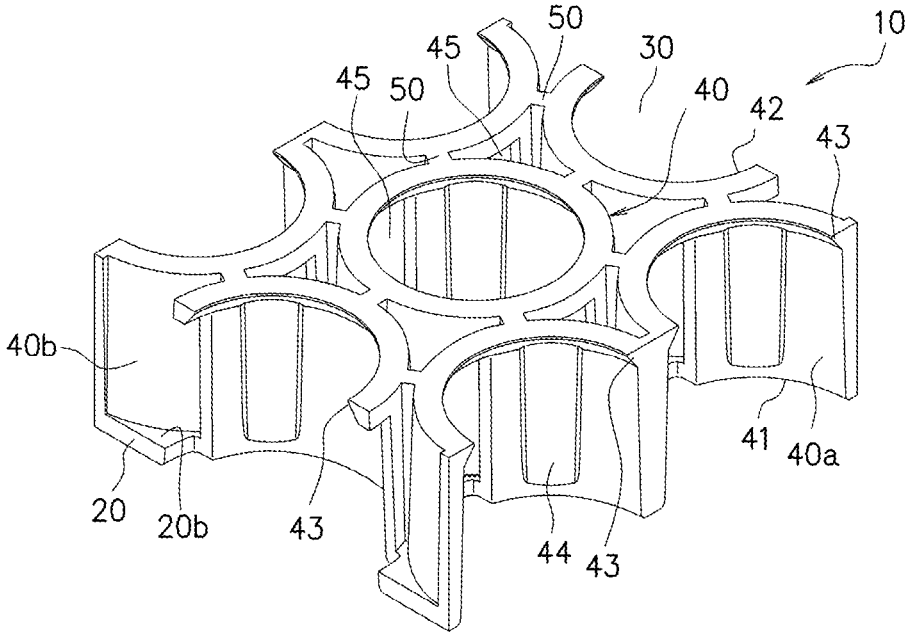

[FIGURE 14]
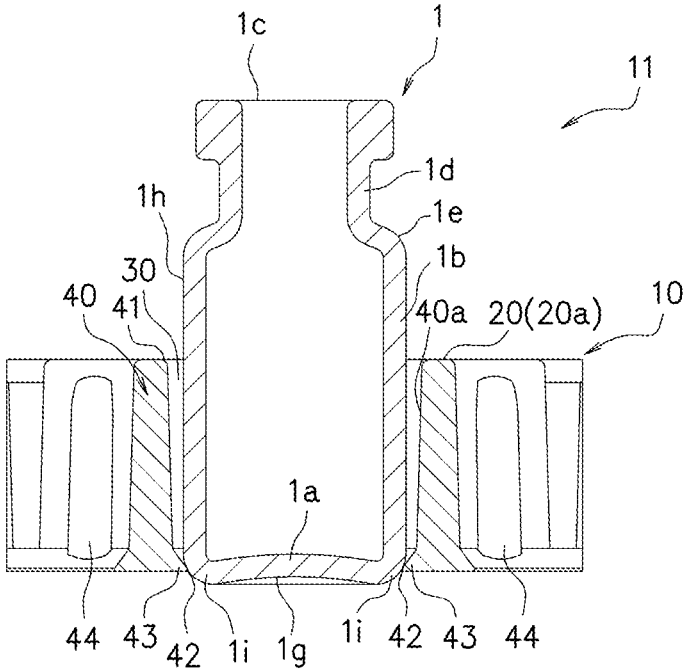
[FIGURE 15]
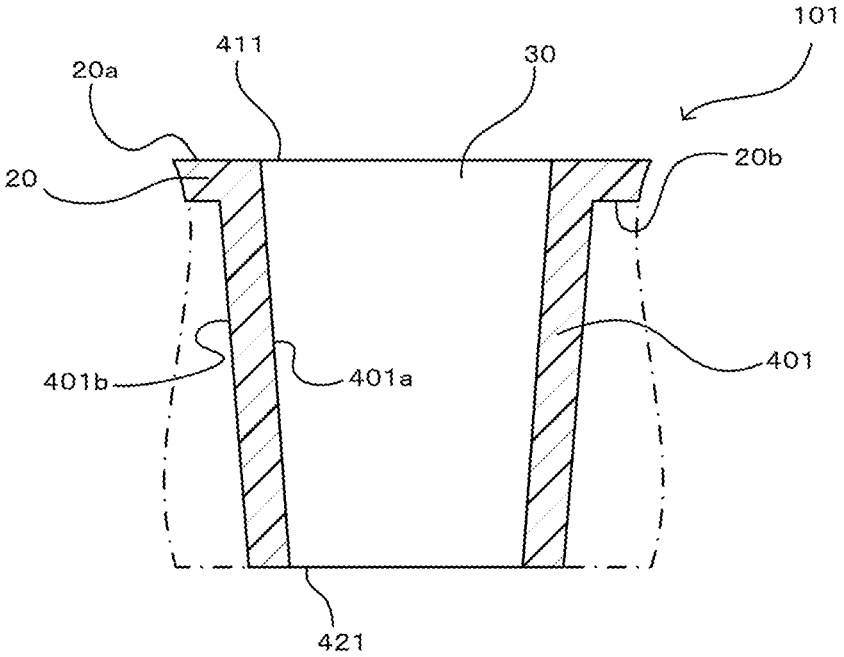

[FIGURE 16]
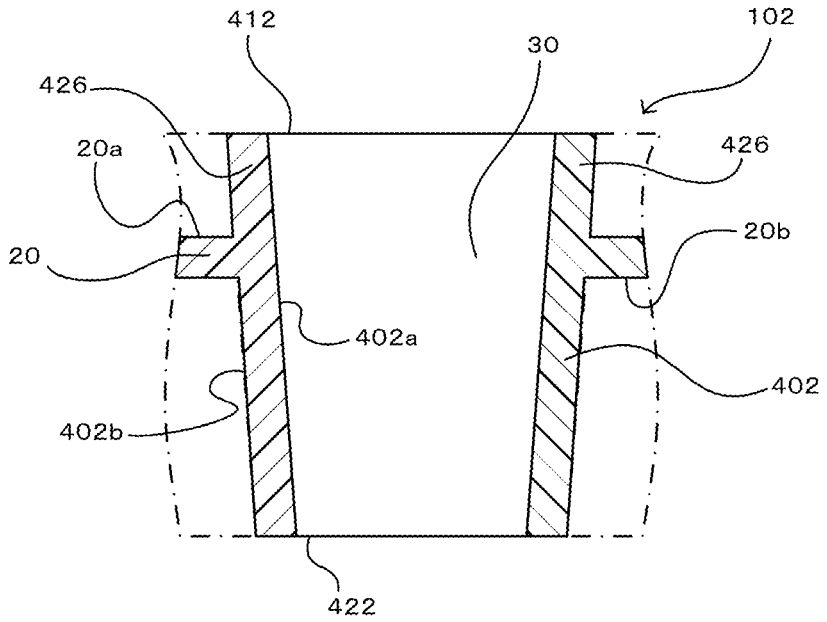
[FIGURE 17]
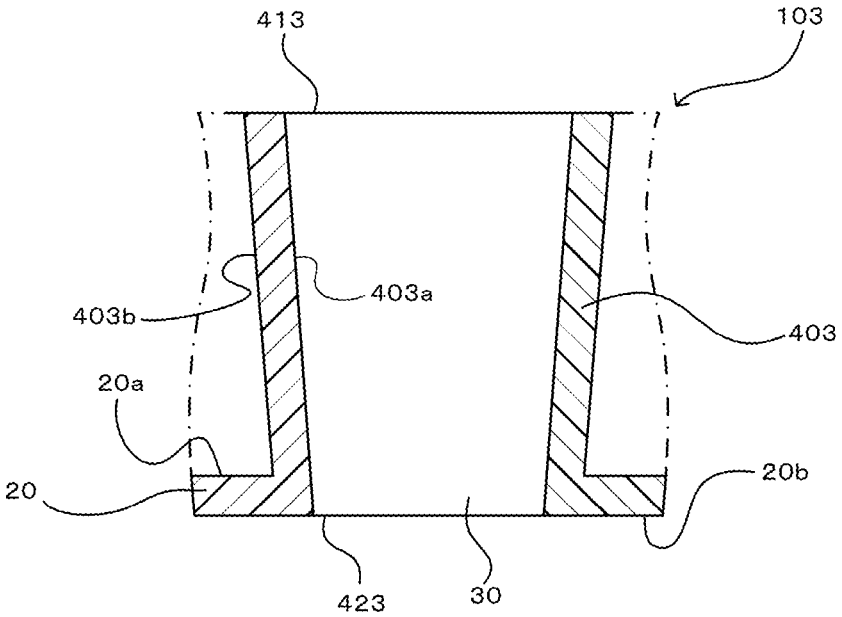

[FIGURE 18]
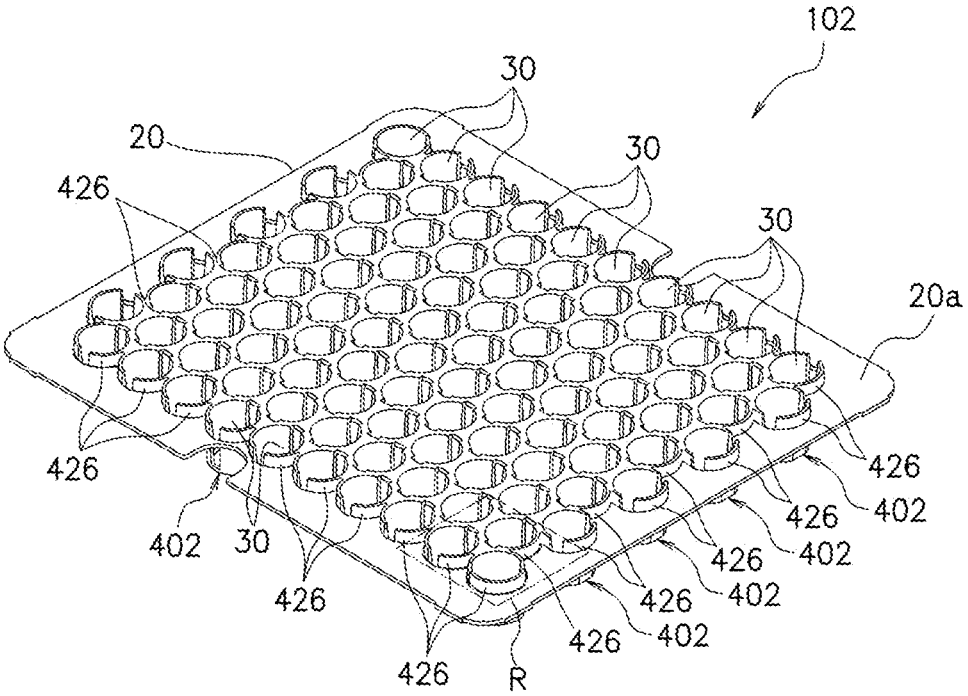
[FIGURE 19]
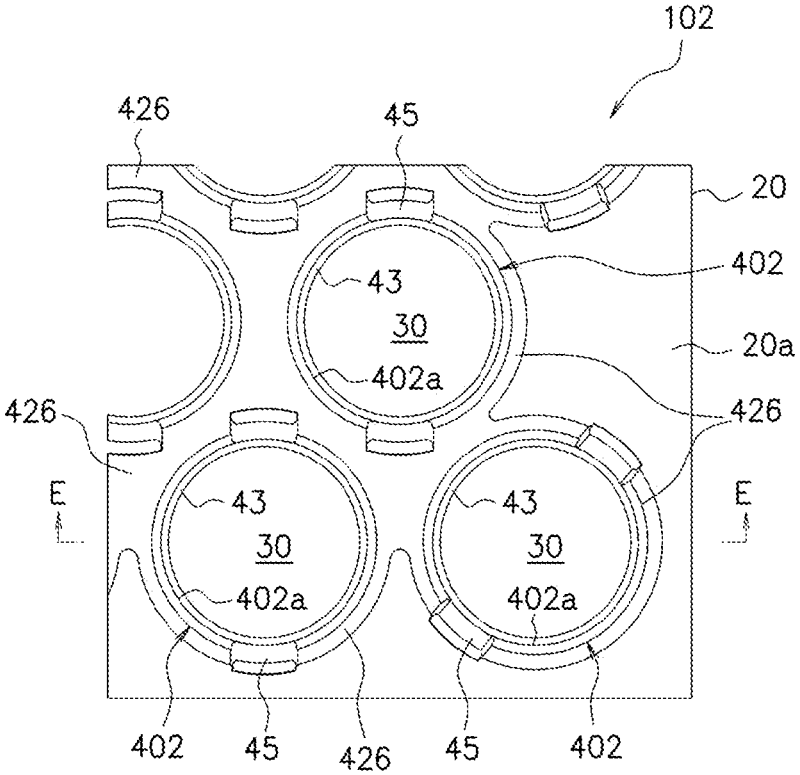

[FIGURE 20]
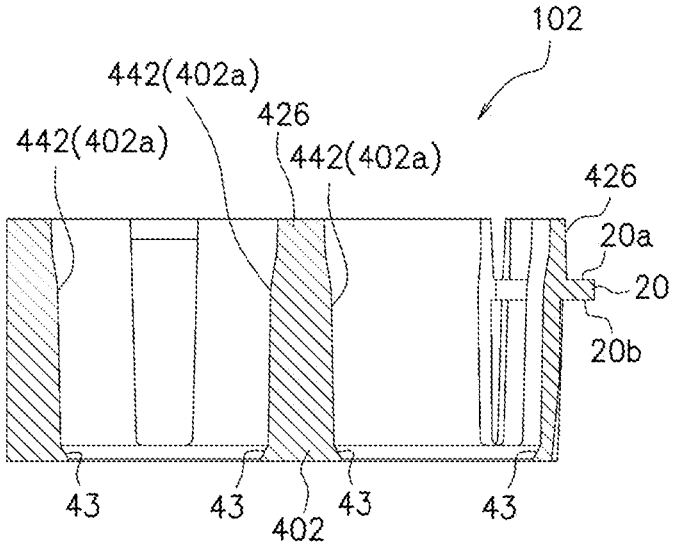
[FIGURE 21]
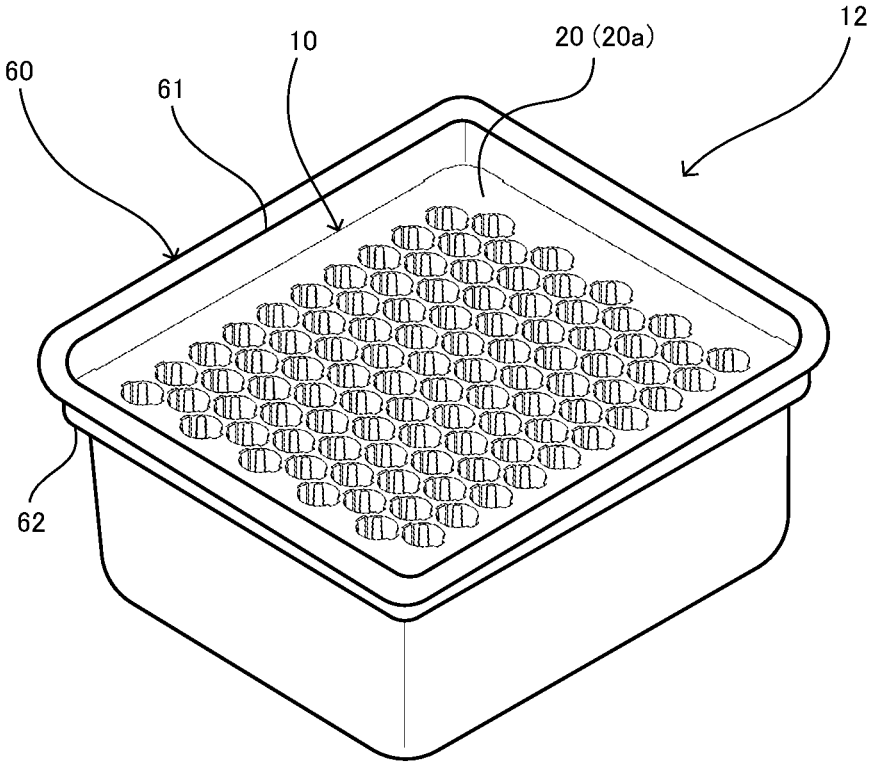

CONTAINER HOLDING MEMBER AND MEDICAL CONTAINER SET

TECHNICAL FIELD

The present invention relates to a container holding member capable of holding a plurality of medical containers, and to a medical container set provided with the medical containers and the container holding member.

BACKGROUND ART

A medical container such as a vial, an ampule, or a syringe barrel is a container in which a liquid medicine, a specimen taken from a human body, or the like is injected, and therefore when a microorganism is adhered to the surface or the like thereof, it may have a serious influence on the liquid medicine or the specimen. Accordingly, the medical container is generally used after sterilization.

As a method for sterilization, high-pressure steam sterilization is widely adopted in which a medical container to be an object of sterilization is exposed to a high-temperature/high-pressure steam atmosphere for a certain time (for example, at 121° C., for 20 minutes) to be sterilized. In the high-pressure steam sterilization, a container holding member capable of holding a plurality of medical containers is utilized for sterilizing or transporting a large number of medical containers at a time.

For example, Patent Literature 1 discloses a tray for medical containers, wherein a plurality of depressions corresponding to the head portions or bottom portions of the medical containers are formed at a floor of a tray. In addition, for example, Patent Literature 2 discloses a container holding tray having a bottom surface portion and a container holding projection formed at the bottom surface portion. The container holding projection in this container holding tray has a tapered shape in which the lower end side is thick, and the upper end side is thin. A plurality of projections are arranged in a lattice-like manner or a staggered manner, and 3 or 4 projections which are adjacent to one another are integrated to encircle the space inside the projections, thereby forming a container holding section corresponding to one medical container.

CITATION LIST

Patent Literature

Patent Literature 1: National Publication of International Patent Application No. 2008-505029

Patent Literature 2: International Publication No. WO2014069244

SUMMARY OF INVENTION

Technical Problem

The container holding members as disclosed in Patent Literature 1 and Patent Literature 2 have an advantage of being capable of simply, quickly and efficiently aligning a plurality of medical containers to appropriate positions and directions.

It is desired for the container holding member capable of holding a plurality of medical containers that holding, transportation, and the like of the medical containers are possible, and, further, that the freeze-drying or sterilization treatment can be performed more efficiently while the medical containers are held in the container holding member.

Accordingly, in consideration of such actual circumstances, the present invention intends to provide a container holding member that is capable of simply, surely, and stably holding a plurality of medical containers, and that is usable for medical containers efficiently.

Solution to Problem

According to the present invention, there is provided a container holding member capable of holding a plurality of bottomed tubular medical containers, wherein the container holding member is provided with: a flat plate-like substrate section having a plurality of through holes each penetrating one surface and the other surface; and a plurality of tubular housing sections each having an upper side opening end on a side of the one surface of the substrate section and a lower side opening end on a side of the other surface and each protruding upward or downward from a hole edge of each of the through holes, and the tubular housing sections are each configured to be capable of holding each of the medical containers in a state where an outer bottom surface of each of the medical containers protrudes downward from the lower side opening end when the medical containers are housed in the tubular housing sections.

Advantageous Effects of Invention

According to the present invention, a container holding member that is capable of simply, surely, and stably holding a plurality of medical containers, and that is usable efficiently for medical containers, and a medical container set provided with the container holding member, the medical container set making it possible to perform more efficient freeze-drying and sterilization treatment can be provided.

BRIEF DESCRIPTION OF DRAWINGS

FIG. 1 shows a sectional view illustrating one example of a medical container to be an object of holding by a container holding member of an embodiment according to the present invention.

FIG. 2 shows a sectional view illustrating another example of a medical container to be an object of holding by a container holding member of an embodiment according to the present invention.

FIG. 3 shows a plan view (top view) when a container holding member of one example of an embodiment according to the present invention is viewed from above.

FIG. 4 shows a plan view (bottom view) when the container holding member illustrated in FIG. 3 is viewed from below.

FIG. 5 shows a front view of the container holding member illustrated in FIG. 3.

FIG. 6 shows a right-side view of the container holding member illustrated in FIG. 3.

FIG. 7 shows a perspective view of the container holding member illustrated in FIG. 3.

FIG. 8 shows an enlarged top view illustrating a portion where portions A-A and B-B are superposed in FIG. 3.

FIG. 9 shows an enlarged bottom view illustrating a portion where portions A-A and B-B are superposed in FIG. 3.

FIG. 10 shows a sectional view taken along line C-C in FIG. 8.

FIG. 11 shows a sectional view taken along line D-D in FIG. 8.

FIG. 12 shows an enlarged perspective view illustrating a portion where portions A-A and B-B are superposed in FIG. 3.

FIG. 13 shows an enlarged perspective view on a bottom surface side of a portion where portions A-A and B-B are superposed in FIG. 3.

FIG. 14 shows a sectional view illustrating a state where a medical container is housed in a tubular housing section in the container holding member illustrated in FIG. 3, the sectional view corresponding to FIG. 11.

FIG. 15 shows a schematic sectional view illustrating another configuration example of a container holding member of an embodiment according to the present invention, the schematic sectional view corresponding to FIG. 11.

FIG. 16 shows a schematic sectional view illustrating still another configuration example of a container holding member of an embodiment according to the present invention, the schematic sectional view corresponding to FIG. 11.

FIG. 17 shows a schematic sectional view illustrating yet another example of a container holding member of an embodiment according to the present invention, the schematic sectional view corresponding to FIG. 11.

FIG. 18 shows a perspective view illustrating one example of a total configuration of the container holding member as illustrated in FIG. 16.

FIG. 19 shows an enlarged top view of a portion denoted as region R shown in FIG. 18.

FIG. 20 shows a sectional view taken along line E-E in FIG. 19.

FIG. 21 shows a perspective view illustrating one example of a package product using a container holding member of an embodiment according to the present invention.

DESCRIPTION OF EMBODIMENTS

Hereinafter, an embodiment according to the present invention will be described; however, the present invention is not limited to the embodiment below.

<Container Holding Member>

A container holding member according to the embodiment of the present invention is capable of holding a plurality of bottomed tubular medical containers. This container holding member is provided with: a flat plate-like substrate section having a plurality of through holes each penetrating one surface and the other surface; and a plurality of tubular housing sections each having an upper side opening end on a side of the one surface of the substrate section and a lower side opening end on a side of the other surface and each protruding upward or downward from a hole edge of each of the through holes. The tubular housing sections are each configured to be capable of holding each of the medical containers in a state where an outer bottom surface of each of the medical containers protrudes downward from the lower side opening end when the medical containers are housed in the tubular housing sections.

The container holding member according to the present embodiment is provided with a plurality of tubular housing sections and therefore can hold a plurality of medical containers simply, surely, and stably when the medical containers are housed in respective tubular housing sections. Thereby, sterilization treatment such as high-pressure steam sterilization can be performed at a time in a state where a plurality of medical containers are held in the container holding member, and, in addition, the plurality of medical containers can be transported as they are.

When a plurality of medical containers are transported in a state where the medical containers are held in the container holding member, each medical container is held surely and stably in each tubular housing section of the container holding member, and therefore it can be avoided that the plurality of medical containers rub against one another. Thus, when the container holding member is utilized, it can be suppressed that the surfaces of the medical containers are damaged, and that the medical containers are broken.

Moreover, the lower side of each of the tubular housing sections in the container holding member opens as the lower side opening end, and therefore water drops produced by condensation of steam are hard to retain in the tubular housing sections, for example, in performing high-pressure steam sterilization.

From various advantages described above, the container holding member according to the present embodiment can be used more efficiently for holding the medical containers, transporting the medical containers, performing sterilization treatment on the medical containers, and other purposes.

Furthermore, when a medical container is housed in a tubular housing section by the tubular housing section, the container holding member according to the present embodiment can hold the medical container in a state where the outer bottom surface of the medical container protrudes downward from the lower side opening end of the tubular housing section. Thereby, when freeze-drying treatment is performed in a state where a plurality of medical containers are held in the container holding member, the outer bottom surface of each of the medical containers, which protrudes downward from the lower side opening end of each of the tubular housing sections, comes into contact with a table in a freeze-drying machine to make it easy to transform heat to the medical containers, making it possible to enhance cooling efficiency. Thus, when the container holding member according to the present embodiment is used, freeze-drying treatment can be performed efficiently on the respective contents (for example, medicines such as liquid medicine and injection agent, and biological specimens such as blood and cell) in a plurality of medical containers. Accordingly, the container holding member according to the present embodiment can be used further efficiently for performing freeze-drying medical containers (contents in containers).

Firstly, the medical container to be an object of holding by the container holding member according to the present embodiment will be described with FIG. 1 and FIG. 2. FIG. 1 shows a sectional view illustrating one example of a medical container (medical container 1) to be an object of holding by the container holding member according to the present embodiment, and FIG. 2 shows a sectional view illustrating another example of the medical container (medical container 2).

The medical container to be an object of holding by the container holding member according to the present embodiment is not particularly limited as long as the medical container has a tubular shape having a bottom (bottomed tubular shape). The "tubular shape" means a shape in which an inner space from one end portion toward the other end portion is formed. Examples of the tubular shape include a cylindrical shape, rectangularly tubular shape such as square tubular shape, and shapes almost equivalent to these (such as approximately cylindrical shape).

Moreover, the "tubular shape" includes not only a shape in which the outer diameter (outer width) and the inner diameter (inner width) are constant from one end portion to the other end portion in a medical container but also a tubular shape having a portion where both the outer diameter (outer width) and the inner diameter (inner width) are different from the other portion. For example, a vial such as a medical container 1 illustrated in FIG. 1 has a large-diameter body portion 1*b* which is positioned on the side of a bottom portion 1*a* (one end portion 1*a*); and a shoulder portion 1*e* which connects a small-diameter neck portion 1*d* positioned on the side of an opening portion 1*c* (the other end portion 1*c*), a body portion 1*b*, and a neck portion 1*d*, and in which the diameter gets narrower from the body portion 1*b* toward the neck portion 1*d*. Such a shape is included in the "tubular shape". It is to be noted that some vials (medical containers 1) exist in which a lip if that forms the opening portion 1*c* is directly connected to the shoulder portion 1*e* and the neck portion 1*d* is substantially absent or the neck portion 1*d* is extremely short. Such a shape is also included in the "tubular shape".

The "bottomed shape" in the bottomed tubular medical container means a shape having a bottom portion that completely or partially closes one end portion of a tubular structure. Accordingly, the bottom portion of the medical container may have a shape that completely closes one end of the tubular structure; however, the shape of the bottom portion is not limited thereto, and the bottom portion may have a shape in which the bottom portion is partially open.

Moreover, it is not necessary that the bottom portion of the medical container is positioned on the lower side of the medical container at the time of use. For example, a syringe barrel such as a medical container 2 illustrated in FIG. 2 has a tubular shape in which the side of one end portion 2*a* of the body portion 2*b* is partially closed, and the side of the other end portion 2*c* is open; and has a "bottom portion" on the side of the other end portion 2*a*. The syringe barrel (medical container 2) has a shape in which the bottom portion 2*a* is partially open, not completely closed, because a hole 2*e* is formed at a tip portion 2*d* of the bottom portion 2*a*. Such a shape is also included in the "bottomed shape".

An outer bottom surface 1*g*, 2*g* of the medical container 1, 2 protrudes downward from the lower side opening end of a tubular housing section (hereinafter, this state is sometimes referred to as "exposed state") when the medical container 1, 2 is housed in the tubular housing section in the container holding member according to the present embodiment. This outer bottom surface 1*g*, 2*g* of the medical container 1, 2 means the surface of the outside of the above-described bottom portion 1*a*, 2*a*. Moreover, in the case of the medical container 1 provided with a rounded corner portion 1*i* described later, the outer bottom surface 1*g* means the surface of the outside of the bottom portion 1*a* not including rounded portions due to the rounded corner portion 1*i*.

The medical container 1 illustrated in FIG. 1, such as a vial and an ampule, is preferably provided with a rounded corner portion 1*i* having a predetermined radius of curvature, the rounded corner portion 1*i* being formed between the outer bottom surface 1*g* and an outer circumferential surface 1*h* (side surface of outside of portion having tubular shape). It is to be noted that the medical container 2 illustrated in FIG. 2 may also be provided with a rounded corner portion having a predetermined radius of curvature, the rounded corner portion being formed between the outer bottom surface 2*g* and an outer circumferential surface 2*h*.

Specific examples of the medical container include a vial, an ampule, and a syringe barrel. The container holding member according to the present embodiment is more suitably used for holding vials among the medical containers. The vial, such as the medical container 1 illustrated in FIG. 1, is generally provided with a rounded corner portion 1*i* having a predetermined radius of curvature, the rounded corner portion 1*i* being formed between the outer bottom surface 1*g* and the outer circumferential surface 1*h*. The material of the vial (medical container 1) may be made of a plastic or glass. The container holding member according to the present embodiment has an advantage that the cooling efficiency during freeze-drying treatment is easily enhanced, as described above, and therefore is further suitably used for holding vials each made of glass.

Next, the container holding member according to the present embodiment will be described in detail giving a container holding member of one example according to the present embodiment. FIGS. 3 to 13 each show a diagram illustrating a container holding member 10 of one example according to the present embodiment. FIG. 14 shows a sectional view illustrating a state where the medical container 1 (see FIG. 1) described above is housed in a tubular housing section 40 in the container holding member 10. Hereinafter, description will be mainly made giving as an example a case where the medical container 1 is housed in the tubular housing section 40 in the container holding member 10.

The container holding member 10 illustrated in FIGS. 3 to 13 is provided with: a flat-shaped substrate section 20 having a plurality of through holes 30; and a plurality of tubular housing sections 40 capable of housing and holding a plurality of medical containers (see, for example, FIGS. 3 to 7). In this container holding member 10, the substrate section 20 has a plurality of through holes 30 each penetrating one surface 20*a* and the other surface 20*b*. Moreover, the tubular housing section 40 has an upper side opening end 41 on the side of the one surface (upper surface) 20*a* of the substrate section 20 and a lower side opening end 42 on the side of the other surface (lower surface) 20*b* and protrudes downward from a hole edge of each of the through holes 30 of the substrate section 20 (see, for example, FIGS. 8 to 13).

The container holding member 10 is, as will be described later, configured to be capable of holding the medical container in such a way that the outer bottom surface 1*g*, 2*g* of the medical container 1, 2 is in an exposed state when the medical container 1, 2 is housed in the tubular housing section 40. From this, the container holding member 10 holds the medical container 1, 2 in a state where the bottom portion 1*a*, 2*a* of the medical container 1, 2 faces downward (see FIG. 14). In addition, the upper side opening end 41 of the tubular housing section 40 functions as an insertion opening for the medical container 1, 2.

The substrate section 20 and the tubular housing section 40 may be formed with different materials but are preferably formed integrally with the same material such as the same resin or the same metal. When the container holding member 10 is produced through molding with a resin material, or, among others, a thermoplastic resin, the substrate section 20 and the tubular housing section 40 can be formed integrally with the same resin material simply at low cost. The resin material for forming the container holding member 10 (substrate section 20 and tubular housing section 40) is not particularly limited, and examples of suitable resin materials include polyolefin resins such as polyethylene and polypropylene. The method for molding the container holding member 10 is not particularly limited, and publicly known molding methods such as injection molding, vacuum forming, and pressure forming can be used.

The shape, size, thickness, and the like of the substrate section 20 in the container holding member 10 are not particularly limited and can be set appropriately according to the material for the substrate section 20, the numbers of through holes 30 and tubular housing sections 40 arranged, the size of the through hole 30, the depth of the tubular housing section 40, and the like. Examples of suitable shapes of the substrate section 20 as viewed in planar view from above the substrate section 20 include an approximately rectangular shape, an approximately square shape, and an approximately circular shape as illustrated in FIG. 3, FIG. 4, and FIG. 7. In the case where the shape of the substrate section 20 as viewed in planar view is the approximately rectangular shape or the approximately square shape, examples of the size of the substrate section 20 include a substrate section the long sides of which are from about 200 to about 500 mm and the narrow sides of which are from about 100 to about 400 mm. Moreover, the substrate section 20 preferably has a thickness of about 0.5 to about 5 mm from the viewpoint of configuring the container holding member 10 having a light weight and having the strength that is durable for use.

Both the plurality of through holes 30 and the plurality of tubular housing sections 40 in the container holding member 10 are preferably arranged in a staggered manner or a lattice-like manner. Thereby, a plurality of medical containers 1, 2 can be held by the container holding member 10 in a state where the medical containers are aligned regularly on a plane of the same level. In each of FIG. 3, FIG. 4, FIG. 7, and the like, a configuration in which both the plurality of through holes 30 and the plurality of tubular housing sections 40 are arranged in a staggered manner relative to the substrate section 20 is given as an example. Both the plurality of through holes 30 and the plurality of tubular housing sections 40 are preferably arranged in a staggered manner rather than in a lattice-like manner relative to the substrate section 20 because a large number of through holes 30 and of tubular housing sections 40 can be provided easily.

The number of through holes 30 and of tubular housing sections 40 in the container holding member 10 correspond to the number of medical containers 1, 2 held in the container holding member 10, and these numbers are not particularly limited. For example, preferably 9 (for example, lengthwise 3×widthwise 3) or more, more preferably 25 (for example, lengthwise 5×widthwise 5) or more, and still more preferably 49 (for example, lengthwise 7×widthwise 7) or more through holes 30 and tubular housing sections 40 can be provided from the viewpoint that it is more efficient when sterilization treatment, transportation, and the like can be performed on a large number of medical containers 1, 2 at once. In each of FIG. 3, FIG. 4, FIG. 7, and the like, the container holding member in which 100 through holes 30 and tubular housing sections 40 are provided by being arranged in a staggered manner of 10 lengthwise×10 widthwise relative to the substrate section 20 is given as an example.

As illustrated in FIG. 14, the tubular housing section 40 is configured to be capable of holding the medical container 1 in a state where the outer bottom surface 1*g* of the medical container 1 protrudes downward from the lower side opening end 42 (exposed state) when the medical container 1 is housed in the tubular housing section 40.

The degree of protrusion of the medical container 1 downward from the lower side opening end 42 of the tubular housing section 40 is preferably 25% or less, more preferably 15% or less, and still more preferably 10% or less of the height on the lower side of the medical container 1. Moreover, in the case where the medical container 1 provided with a rounded corner portion 1*i* is held in the tubular housing section 40, the tubular housing section 40 is further preferably configured to be capable of holding the medical container 1 in a state where a portion that is on the lower side from the rounded corner portion 1*i* of the medical container 1 protrudes downward from the lower side opening end 42 of the tubular housing section 40. As a more suitable, specific example, when a case where a vial having a height of about 20 to about 40 mm is housed in the tubular housing section 40 is given as an example, the tubular housing section 40 is preferably configured to be capable of holding the medical container 1 in a state where the housed medical container 1 protrudes 0.1 to 5 mm (more suitably 0.2 to 2 mm) downward from the lower side opening end 42 of the tubular housing section 40.

As illustrated in the above-described configuration, the tubular housing section 40 is preferably configured to be capable of holding the medical container 1 in a state where a small portion or a minute portion which is on the side of the bottom portion 1*a* including the outer bottom surface 1*g* of the medical container 1, not most of the medical container 1, protrudes downward from the lower side opening end 42. Due to such a configuration, the container holding member 10 can hold a plurality of medical containers 1 further surely and stably, and transportation and sterilization treatment of the plurality of medical containers 1 held in the container holding member 10 can be performed more efficiently. In addition, when the container holding member 10 holding the medical containers 1 is placed on a table in a freeze-drying machine, the outer bottom surface 1*g* of each of the medical containers 1 comes into contact with the table in the freeze-drying machine, and therefore the cooling efficiency is improved, and freeze-drying treatment can be performed efficiently. Furthermore, when the container holding member 10 holding the medical containers 1 is placed on a table or the like, the outer bottom surface 1*g* of each of the medical containers 1 comes into contact with the table, and then the end surface of the lower side opening end 42 of the container holding member 10 also comes into contact with the table; however, the relative amount of transfer between the container holding member 10 and the each of the medical containers 1 is small. Thus, it can be suppressed that the tubular housing section 40 and the medical container 1 rub against each other, and it can be suppressed that the surface of the medical container 1 is damaged.

The tubular housing section 40 preferably has a tubular shape corresponding to a tubular shape of the medical container 1, and the shape of the opening of the lower side opening end 42 is preferably formed to be larger than the shape of the external form of the outer bottom surface 1*g* of the medical container 1 and to be smaller than the outer width of the medical container 1.

That the tubular housing section 40 has a tubular shape corresponding to a tubular shape of the medical container 1, 2 herein means that the tubular shape of the tubular housing section 40 and the tubular shape of the medical container is in a correspondence relationship. Examples of the correspondence relationship include a relationship in which when the medical container 1, 2 is cylindrical, the tubular housing section 40 is also cylindrical, a relationship in which when the medical container 1, 2 is elliptically cylindrical, the tubular housing section 40 is also elliptically cylindrical, and a relationship in which when the medical container 1, 2 is rectangularly tubular, the tubular housing section 40 is also rectangularly tubular.

In addition, the shape of the opening of the lower side opening end 42 of the tubular housing section 40 means a shape of an opening as viewed in planar view from the lower side of the lower side opening end 42, as shown in the bottom view (see FIG. 4 and FIG. 9) viewed from the lower side of the container holding member 10.

Furthermore, the outer width of the medical container 1, 2 means the maximum outer width existing, for example, in the body portion 1*b*, 2*b*, or the like in the medical container 1, 2. That the shape of the opening of the lower side opening end 42 of the tubular housing section 40 is formed to be smaller than the outer width of the medical container 1, 2 means that the medical container 1, 2, when housed in the tubular housing section 40, does not fallout downward from the tubular housing section 40.

When a case where a vial having a diameter of the outer bottom surface of about 10 to about 20 mm is housed in the tubular housing section 40 is given as an example, the shape of the opening (opening diameter) of the lower side opening end 42 of the tubular housing section 40 is preferably 0.1 to 1 mm smaller, more preferably 0.2 to 0.5 mm smaller than the outer width (outer diameter) of the vial (medical container). Moreover, in the case of this example, the shape of the opening (opening diameter) of the lower side opening end 42 of the tubular housing section 40 is preferably 0.1 to 1 mm larger, more preferably 0.2 to 0.5 mm larger than the shape of the external form (outer diameter) of the outer bottom surface of the vial (medical container).

In the case where the medical container 2 illustrated in FIG. 2, such as a syringe barrel, is held in the container holding member 10, the outer bottom surface of only the tip portion 2*d* in the bottom portion 2*a* of the medical container 2 (portion of outer bottom surface 2*g*) may be in the exposed state. Thus, in this case, it is not required for the tubular housing section 40 that the shape of the opening of the lower side opening end 42 is formed to be larger than the shape of the external form of the outer bottom surface 2*g* in the bottom portion 2*a* (whole bottom portion) of the medical container 2. When the lower side opening end 42 of the tubular housing section 40 is configured to support the outer bottom surface 2*g* in the bottom portion 2*a* excluding the tip portion 2*d* in the medical container 2, the outer bottom surface of only the tip portion 2*d* in the bottom portion 2*a* can be made into the exposed state easily.

In the case where the medical container 1 provided with a rounded corner portion 1*i* between the outer bottom surface 1*g* and the outer circumferential surface 1*h* (see FIG. 1) is housed in the tubular housing section 40, the shape of the opening of the lower side opening end 42 of the tubular housing section 40 is preferably formed to be larger than the shape of the external form of the outer bottom surface 1*g* of the medical container 1, and to be smaller than the outer width of the medical container 1. Thereby, the outer bottom surface 1*g* of the medical container 1 can be made to be in the exposed state easily. In the case where the medical container 1 such as a vial is housed in the tubular housing section 40, the side of the upper side opening end 41 of the tubular housing section 40 is preferably formed to be larger than the body portion 1*b* of the medical container 1, and the side of the lower side opening end 42 of the tubular housing section 40 is preferably formed to be smaller than the body portion 1*b* of the medical container 1.

When the medical container 1, such as a general vial, is provided with a rounded corner 1*i* having a predetermined radius of curvature, the rounded corner portion 1*i* formed between the outer bottom surface 1*g* and the outer circumferential surface 1*h*, the diameter (or width) of the outer bottom surface 1*g* of the medical container 1 is usually smaller than the maximum outer diameter (or outer width) of the medical container 1. When such a medical container 1 is housed in the tubular housing section 40 in the container holding member 10, the medical container 1 is in a state where only the portion that is on the lower side from the rounded corner portion 1*i* in the medical container 1 protrudes downward from the lower side opening end 42 of the tubular housing section 40. Accordingly, in this case, the container holding member 10 can hold a plurality of medical containers 1 more surely and stably while holding the plurality of medical containers 1 in the exposed state.

For example, as illustrated in FIGS. 10 to 12, in the container holding member 10, the tubular housing section 40 is preferably provided with a flange portion 43 at the lower side opening end 42, the flange portion 43 being provided to extend from an inner circumferential wall surface 40*a* in the tubular housing section 40 toward the inside of the tubular housing section 40. In this case, the flange portion 43 forms the lower side opening end 42. When the tubular housing section 40 is provided with the flange portion 43 that forms the lower side opening end 42, it is easy to hold the medical container 1 more surely and stably while keeping the outer bottom surface 1*g* of the medical container 1 in the exposed state.

For example, as illustrated in FIG. 8, the flange portion 43 is more preferably provided in a circular manner over the whole circumference of the lower end of the tubular housing section 40. When the tubular housing section 40 is provided with the flange portion 43 being provided to extend in a circular manner from the whole circumference of the lower end toward the inside of the tubular housing section 40, it is easy to hold the medical container 1 more stably. The circular shape of the flange portion 43 is preferably made to be a shape corresponding to the tubular shape of the tubular housing section 40. In each of FIGS. 3 to 14, the tubular housing section 40 is formed cylindrically, and therefore a configuration in which the flange portion 43 is formed in a circular manner over the whole circumference of the lower end of the tubular housing section 40 is given as an example. It is to be noted that the flange portion 43 may be provided partially in the circumferential direction at the lower end of the tubular housing section, and in this case, a plurality of flange portions 43 may be provided.

In the case where the tubular housing section 40 in the container holding member 10 is provided with the flange portion 43, the container holding member 10 is more suitably used for holding the medical containers 1 each provided with the above-described rounded corner portion 1*i*. In this case, the flange portion 43 is more preferably provided to come into contact with the rounded corner portion 1*i* of the medical container 1 when the medical container 1 is housed in the tubular housing section 40 in that it becomes easy to hold the medical container 1 in the exposed state with the configuration. The flange portion 43 is provided to come into contact with the rounded corner portion 1*i* of the medical container 1 when the medical container 1 is housed in the tubular housing section 40 to be held in the container holding member 10, so that the medical container 1 is retained in the tubular housing section 40 due to the rounded corner portion 1*i* and does not fall out, and a state where the outer bottom surface 1*g* of the medical container 1 protrudes downward from the lower side opening end 42 of the tubular housing section 40 can be made (see FIG. 14). In this case, the medical container 1 is held in the container holding member 10 in a state where the portion that is on the lower side from the rounded corner portion 1*i* (portion including outer bottom surface 1*g*) protrudes downward from the lower side opening end 42 of the tubular housing section 40.

The flange portion 43 may be provided to extend from the inner circumferential wall surface 40*a* of the tubular housing section 40 toward the inside of the tubular housing section 40 in a perpendicular direction relative to the inner circumferential wall surface 40*a*, but is more preferably provided to be inclined downward toward the inside of the tubular housing section 40 (see FIGS. 10 to 14). Thereby, it is easy to allow the outer bottom surface 1*g* of the medical container 1 to protrude downward from the lower side opening end 42 of the tubular housing section 40 when the medical container 1 is housed in the tubular housing section 40. The angle of inclination of the flange portion 43 in this case is preferably an angle that rises from the inner circumferential wall surface 40*a* of the tubular housing section 40, the angle being 10° or more and less than 90°, more preferably 10 to 60°, and still more preferably 45 to 60°.

The flange portion 43 is preferably provided so that the extending distance from the inner circumferential wall surface 40*a* of the tubular housing section 40 toward the inside (width of flange portion 43) corresponds to the radius of curvature of the rounded corner portion 1*i* in the medical container 1. The width of the flange portion 43 can be determined appropriately according to the type, size, and the like of the medical container to be housed in the tubular housing section 40. When a case where a vial having a diameter of the outer bottom surface of about 10 to about 20 mm is housed in the tubular housing section 40 is given as an example, the width of the flange portion 43 is, for example, preferably 0.5 to 5.0 mm, more preferably about 1.0 mm to about 2.5 mm, and still more preferably 1.5 to 2.0 mm.

The flange portion 43 is preferably configured so that the lower end surface of the flange portion 43 (lower end surface of tubular housing section) is positioned preferably 0.1 to 5 mm higher, more preferably 0.2 to 2 mm higher than the outer bottom surface 1*g* of the medical container 1 when the medical container 1 is housed in the tubular housing section 40 to be held in the container holding member 10. Due to the flange portion 43 having this configuration, the medical container 1 can be held further surely and stably while the medical container 1 is made to be in the exposed state.

The tubular housing section 40 is preferably formed to have a shape such that the inside (inner space) of the tubular housing section 40 becomes gradually narrower from the upper side opening end 41 toward the lower side opening end 42 so that the medical container 1 can be held easily in the exposed state (see FIG. 10 and FIG. 11). When the inside of the tubular housing section 40 is formed to have a shape that becomes gradually narrower from the top toward the bottom, the inner space of the tubular housing section 40 becomes the space in which the opening area of the upper side opening end 41 is wide; the opening area becomes gradually smaller from the upper side opening end 41 toward the lower end opening end 42; and the opening area of the lower side opening end 42 is narrow. In such a configuration, the upper side opening end 41 of the tubular housing section 40 can be formed widely to some extent, and thereby, there is also an advantage that the medical container 1, 2 is easily housed in the tubular housing section 40.

As illustrated in FIG. 8 and FIGS. 10 to 13, the tubular housing section 40 is preferably provided with a projection portion 44 at a portion of the inner circumferential wall surface 40*a* of the tubular housing section 40, the projection portion 44 being provided to project toward the inside of the tubular housing section 40. When the projection portion 44 is provided at a portion of the inner circumferential wall surface 40*a* of the tubular housing section 40, a gap can be formed between the outer circumferential surface 1*h*, 2*h* of the medical container 1, 2 and the inner circumferential wall surface 40*a* of the tubular housing section 40 when the medical container 1, 2 is housed in the tubular housing section 40. Steam, a gas, or the like can be distributed efficiently due to this gap, so that sterilization treatment can be performed more effectively.

A plurality of projection portions 44 are preferably provided at a portion of the inner circumferential wall surface 40*a* of the tubular housing section 40, and are more preferably provided in the inner circumferential wall surface 40*a* at positions facing each other through the center in the tubular housing section 40. In each of FIG. 8 and the like, a configuration is given as an example in which 4 projection portions 44 are provided at 4 sites of the inner circumferential wall surface 40*a* of the tubular housing section 40, and two pairs of projection portions 44 are each provided at positions facing each other through the center in the tubular housing section 40.

The tubular housing section 40 is preferably provided with a hole portion 45 penetrating the inner circumferential wall surface 40*a* and the outer circumferential wall surface 40*b* of the tubular housing section 40 (see FIG. 8, FIG. 9, FIG. 12, and FIG. 13). When the hole portion 45 penetrating the inner circumferential wall surface 40*a* and the outer circumferential wall surface 40*b* of the tubular housing section 40 is provided, steam, a gas, or the like can be distributed efficiently through the hole portion 45, so that sterilization treatment can be performed more effectively.

As illustrated in FIG. 12, the hole portion 45 is preferably provided to be connected to the through hole 30 at the one surface (upper surface) 20*a* of the substrate section 20 so that sterilization treatment can be performed further effectively, and a plurality of hole portions 45 are more preferably provided at positions facing each other through the center of the through hole 30. In each of FIG. 8, FIG. 12, and the like, a configuration is given as an example in which two hole portions 45 each connected to the through hole 30 at the one surface (upper surface) 20*a* of the substrate section 20 and each having a recessed groove shape and facing each other through the center of the through hole 30 in planar view as viewed from the side of the upper surface 20*a* of the substrate section 20.

In the plurality of tubular housing sections 40, one tubular housing section 40 and other tubular housing sections 40 each adjacent to the one tubular housing section 40 are preferably connected mutually to one another through the outer circumferential wall surfaces 40*b* of the tubular housing sections 40. Thereby, the plurality of tubular housing sections 40 are reinforced, and therefore the strength of the container holding member 10 can be enhanced, and the period of endurance of the container holding member 10 can be made long. The one tubular housing section 40 and the other tubular housing sections 40 may be directly connected through a portion of their outer circumferential surface walls 40*b*, or may be connected through a connection portion 50 provided on the outer circumferential wall surfaces 40*b* of the tubular housing sections 40 as illustrated in FIG. 9 and FIG. 13. The connection portion 50 is provided in a rod-like shape along with a depth (height) direction of the tubular housing section 40 from the lower surface 20*b* of the substrate section 20 to the lower end of the tubular housing section 40, but the connection portion 50 may be provided in a dot-like manner at a portion in the depth (height) direction of the outer circumferential wall surface 40*b* of the tubular housing section 40.

The container holding member according to the present embodiment can also have each of the configurations which will be described with reference to FIGS. 15 to 17 below.

FIGS. 15 to 17 each show a schematic sectional view for describing a configuration other than the above-described container holding member 10, the schematic sectional view illustrating a container holding member 101, 102, 103 of one example according to the present embodiment and corresponding to FIG. 11. It is to be noted that FIGS. 15 to 17 each show a sectional view schematically illustrating only one tubular housing section in the container holding member. Moreover, the same reference signs as those for the substrate section 20 and the through holes 30 in the container holding member 10 illustrated in each of FIGS. 3 to 14 are given to the substrate section and the through holes in each of FIGS. 15 to 17, and the description thereof is omitted.

In the above-described container holding member 10 illustrated in each of FIGS. 3 to 14, the tubular housing section 40 is provided with the flange portion 43 as described above; however, in the container holding member according to the present embodiment, the tubular housing section 40 does not need to be provided with the flange portion 43. That is, in addition to the configuration in which the tubular housing section 40 comprises the flange portion 43, the container holding member according to the present embodiment can have a configuration by which the medical containers can be held in a state where the outer bottom surface of the medical container protrudes downward from the lower side opening end of the tubular housing section.

For example, as in the case of a container holding member 101 illustrated in FIG. 15, a tubular housing section 401 can be configured to have a shape such that the inside (inner space) of the tubular housing section 401 becomes gradually narrower from an upper side opening end 411 toward a lower side opening end 421 without providing a flange portion in the tubular housing section 401. Due to this configuration, the shape of the opening of the lower side opening end 421 can be formed to be larger than the shape of the external form of the outer bottom surface 1*g* of the medical container 1, and to be smaller than the outer width of the medical container 1. Thus, the container holding member 101 can hold the medical container 1 in a state where the outer bottom surface 1*g* of the medical container 1 protrudes downward from the lower side opening end 421 of the tubular housing section 401.

In the case where the medical container 1 provided with a rounded corner portion 1*i* as described above is housed in the tubular housing section 401, the container holding member 101 is preferably configured so that the rounded corner portion 1*i* of the medical container 1 comes into contact with the inside of the narrowed lower side opening end 421 of the tubular housing section 401. In this case, the container holding member 101 can hold the medical container 1 in a state where the portion that is on the lower side from the rounded corner portion 1*i* of the medical container 1, the portion including the outer bottom surface 1*g*, protrudes downward from the lower side opening end 421 of the tubular housing section 401.

As illustrated in FIG. 15, the container holding member 101 can be configured so that the wall thickness of the tubular housing section 401 is approximately constant, and both an inner circumferential wall surface 401*a* and an outer circumferential wall surface 401*b* of the tubular housing section 401 become gradually narrower from the upper side opening end 411 toward the lower side opening end 421. In addition, the container holding member 101 may be configured so that the inside (inner space) of the tubular housing section 401 becomes gradually narrower by forming the wall thickness of the tubular housing section 401 to become gradually thicker from the upper side opening end 411 toward the lower side opening end 421, which is not illustrated in the figure. In this case, the outer circumferential wall surface 401*b* of the tubular housing section 401 does not need to be formed to become narrower from the upper side opening end 411 toward the lower side opening end 421, and may be formed to be straight in a vertical direction relative to the lower surface 20*b* of the substrate section 20.

The container holding member 10 illustrated in each of FIGS. 3 to 14 is provided with a plurality of tubular housing sections 40 each protruding downward from the hole edge of each of the through holes 30 of the substrate section 20. On the other hand, as in the case of a container holding member 102 illustrated in FIG. 16, a tubular housing section 402 may be provided with a rib portion 426 protruding upward from the hole edge of the through hole 30 of the substrate section 20. This rib portion 426 is preferably formed in a circular manner to correspond to a tubular shape of the tubular housing section 402. Since the container holding member 102 is provided with the rib portion 426, the medical container 1 can be held more stably in the direction of the height thereof. Furthermore, as illustrated in FIG. 17, the configuration of a container holding member 103 may be made to be provided with a plurality of tubular housing sections 403 each protruding upward from the hole edge of the through hole 30 of the substrate section 20.

The container holding member 102, 103 illustrated in FIG. 16 and FIG. 17 is configured to have a shape such that the inside (inner space) of the tubular housing section 402, 403 becomes gradually narrower from an upper side opening end 412, 413 toward a lower side opening end 422, 423 in the same manner as in the container holding member 101 illustrated in FIG. 15. Due to this configuration, the container holding member 102, 103 can hold the medical container 1 in a state where the outer bottom surface 1*g* of the medical container 1 protrudes downward from the lower side opening end 422, 423 of the tubular housing section 402, 403. In the tubular housing section 402, 403, an outer circumferential wall surface 402*b*, 403*b* may also be formed to be straight in a vertical direction relative to the lower surface 20*b* of the substrate section 20 in the same manner as in the tubular housing section 401 described above.

It is to be noted that the container holding member 101, 102, 103 illustrated in each of FIGS. 15 to 17 may be configured so that the tubular housing section 401, 402, 403 is provided with a flange portion at the lower side opening end 421, 422, 423, the flange portion being provided to extend from the inner circumferential wall surface 401*a*, 402*a*, 403*a* of the tubular housing section 401, 402, 403 toward the inside. Moreover, the container holding member 101, 102, 103 illustrated in each of FIGS. 15 to 17 may be configured so that the tubular housing section 401, 402, 403 is provided with a flange portion protruding upward or downward in a vertical direction relative to the one surface 20*a* and the other surface 20*b* of the substrate section 20 from the hole edge of the through hole 30, the flange portion being provided at the lower side opening end 421, 422, 423 of the tubular housing section 401, 402, 403 to extend from the inner circumferential wall surface 401*a*, 402*a*, 403*a* toward the inside.

Furthermore, the container holding member 102 provided with the rib portion 426 as illustrated in FIG. 16 can have each of the configurations illustrated in each of FIGS. 18 to 20. FIG. 18 shows a perspective view illustrating one example of the whole configuration of the container holding member 102 as illustrated in FIG. 16. FIG. 19 shows an enlarged top view of a portion denoted as range R shown in FIG. 18. FIG. 20 shows a sectional view taken along line E-E in FIG. 19. It is to be noted that with respect to constitutional sections or portions in FIGS. 18 to 20 which are in common with the constitutional sections or portions in the container holding member 10 illustrated in each of FIGS. 3 to 14, the same reference signs are given, and the description thereof is omitted.

As illustrated in FIG. 18 and FIG. 19, the container holding member 102 preferably has a configuration in which the rib portion 426 at the upper portion of one tubular housing section 402 and the rib portions 426 at the upper portion of other tubular housing sections 402 each adjacent to the one tubular housing section 402 are connected in a plurality of tubular housing sections 402 (through holes 30). When the rib portions 426 are formed serially at the upper portion of the plurality of tubular housing sections 402 in this way, the rib portions 426 are more reinforced and become more difficult to damage than in the case where the rib portions 426 are provided separately for each tubular housing section 402.

Moreover, as illustrated in FIG. 20, the container holding member 102 provided with the rib portion 426 is preferably provided with a projection portion 442 provided to project toward the inside of the tubular housing section 402 at a portion of the inner circumferential wall surface 402*a* of the tubular housing section 402. The projection portion 442 is more preferably provided over the circumferential direction at a portion in the height direction of the inner circumferential wall surface 402*a* of the tubular housing section 402, and is still more preferably provided in such a way that the wall of a portion in the height direction of the inner circumferential wall surface 402*a* is formed to be thicker than the other portion. In FIG. 20, a configuration is given as an example in which a projection portion 442 the wall thickness of which at a position corresponding to the substrate section 20 in the height direction of the inner circumferential wall surface 402*a* is thicker than the other positions is provided over the circumferential direction. When the container holding member 102 provided with the rib portion 426 is provided with the projection portion 442 at a portion of the inner circumferential wall surface 402*a* of the tubular housing section 402, the medical container 1 can be held further stably in the direction of the height thereof.

As in the configuration examples described with reference to FIGS. 15 to 20, each configuration in the above-described container holding member 10 illustrated in each of FIGS. 3 to 14 and the container holding member 101, 102, 103 illustrated in each of FIGS. 15 to 20 can also be configured in combination arbitrarily.

<Medical Container Set>

A medical container set of one embodiment according to the present invention is provided with: a container holding member; and a plurality of bottomed tubular medical containers each housed and held in a tubular housing section in the container holding member.

As the container holding member and the medical container each provided in the medical container set according to the present embodiment, the above-described container holding member 10, 101, 102, 103 and medical container 1, 2 can be used respectively. For example, as illustrated in FIG. 14 described above, a medical container set 11 of one example according to the present embodiment can be provided with: the container holding member 10 and a plurality of medical containers 1 each housed and held in the tubular housing section 40 in the container holding member 10.

The medical container set 11 may be provided with a box type container configured to be capable of installing therein the container holding member 10 in which a plurality of medical containers 1 are housed. The form of this box type container is not particularly limited, and, for example, a box type container 60 as illustrated in FIG. 21 can be used.

Moreover, by using the box type container, a package product provided with: the box type container; and a container holding member housed in the box type container can be provided. As illustrated in FIG. 21, a package product 12 may have a configuration such that the container holding member 10 in which a medical container is not housed is housed in the box type container 60, and preferably has a configuration such that the container holding member 10 in which a plurality of medical containers are held is housed in the box type container 60 (one aspect of medical container set). In the box type container 60 which can be used for the medical container set 11 and the package product 12, a plurality of container holding members 10 may be housed. An upper opening 61 of the box type container 60 in which the container holding member 10 is housed may be closed with a film-like or sheet-like sealing member.

The box type container 60 preferably has a side shoulder portion 62 formed by a level difference at a side surface portion thereof and is preferably provided with a shelf-like portion for mounting the container holding member 10 at the inner wall surface corresponding to the side shoulder portion 62. This shelf-like portion is preferably provided to support the outer peripheral side of the substrate section 20 in the container holding member 10 above the bottom surface (inner bottom surface) of the box type container 60 from the vertical direction relative to the bottom surface and to separate the bottom portion of the medical container from the bottom surface of the box type container. In this case, the container holding member 10 is housed in the box type container 60 so that the upper surface 20*a* of the substrate section 20 is positioned on the side of the upper opening 61 of the box type container 60. Moreover, the container holding member 10 is preferably housed in the box type container 60 so that the upper surface 20*a* (and lower surface) of the substrate section 20 is approximately parallel to the bottom surface of the box type container 60.

The box type container in which the container holding member which holds a plurality of medical containers is installed may be provided for transportation, sterilization treatment, or the like. It becomes possible to fill the box type container 60 with steam, a gas, or the like, and therefore it becomes possible to perform sterilization treatment more effectively by using the box type container 60.

The container holding member 10 (medical container set 11, package product 12) in which a plurality of medical containers 1 are held therein is suitably provided for a site where a medicine such as a liquid medicine or an injection agent, a biological specimen such as blood or a cell, or the like is produced, prepared, etc. In the site, the medicine, the biological specimen, or the like is filled in each medical container 1 housed in the container holding member 10. After the filling step, each medical container 1 is suitably provided for a step of sealing the medical container 1 (sealing step). In the sealing step, for example, when an ampule is used as the medical container, the ampule is subjected to fusion sealing by an ampule filling/sealing machine or the like, and when the medical container 1 is a vial, the opening of the vial (see opening portion 1*c* in FIG. 1) is capped with a rubber stopper or the like. In addition, a plurality of medical containers 1 each held in the container holding member 10 are more preferably provided for a freeze-drying treatment step or a sterilization treatment step after the filling step.

According to the container holding member 10 and the medical container set 11 of the present embodiment, a plurality of medical containers 1 can be transported at once by the housing unit of the medical containers 1 in the container holding member 10. Moreover, the above described filling step, freeze-drying treatment step, and sterilization treatment step, and the like can be carried out while holding the plurality of medical containers 1 in the container holding member 10. Thus, by feeding in a product line the container holding member 10 in which a plurality of medical containers 1 are held, a medicine, a biological specimen, or the like can be produced or prepared in a state where the medicine, the biological specimen, or the like is filled in the plurality of medical containers 1 by the housing unit of the medical containers 1 in the container holding member 10 at once. Accordingly, the production or the preparation can be performed efficiently.

The container holding member according to one embodiment of the present invention, which is described above in detail, can also have the constitution below.

[1] A container holding member capable of holding a plurality of bottomed tubular medical containers, wherein the container holding member is provided with: a flat plate-like substrate section having a plurality of through holes each penetrating one surface and the other surface; and a plurality of tubular housing sections each having an upper side opening end on a side of the one surface of the substrate section and a lower side opening end on a side of the other surface and each protruding upward or downward from a hole edge of each of the through holes, and the tubular housing sections are each configured to be capable of holding each of the medical containers in a state where an outer bottom surface of each of the medical containers protrudes downward from the lower side opening end when the medical containers are housed in the tubular housing sections.

[2] The container holding member according to [1], wherein the tubular housing sections each have a tubular shape corresponding to a tubular shape of the medical containers, and a shape of an opening of the lower side opening end is formed to be larger than a shape of an external form of the outer bottom surface of each of the medical containers and to be smaller than outer width of each of the medical containers.

[3] The container holding member according to [1] or [2], wherein the tubular housing sections are each provided with a flange portion at the lower side opening end, the flange portion being provided to extend from an inner circumferential wall surface in each of the tubular housing sections toward an inside of each of the tubular housing sections.

[4] The container holding member according to [3], wherein the medical containers are each provided with a rounded corner portion having a predetermined radius of curvature, the rounded corner portion being formed between the outer bottom surface and an outer circumferential surface, and the flange portion is provided to come into contact with the rounded corner portion of each of the medical containers when the medical containers are housed in the tubular housing sections.

[5] The container holding member according to [3] or [4], wherein the flange portion is provided to be inclined downward toward the inside of each of the tubular housing sections.

[6] The container holding member according to any one of [1] to [5], wherein the tubular housing sections are each formed to have a shape such that an inside of each of the tubular housing sections becomes gradually narrower from the upper side opening end toward the lower side opening end.

[7] The container holding member according to any one of [1] to [6], wherein the tubular housing sections are each provided with a projection portion at a portion of an inner circumferential wall surface of each of the tubular housing sections, the projection portion being provided to project toward an inside of each of the tubular housing sections.

[8] The container holding member according to any one of [1] to [7], wherein the tubular housing sections are each provided with a hole portion penetrating an inner circumferential wall surface and an outer circumferential wall surface of each of the tubular housing sections.

[9] The container holding member according to any one of [1] to [8], wherein both the plurality of through holes and the plurality of tubular housing sections are arranged in a staggered manner or a lattice-like manner relative to the substrate section.

[10] The container holding member according to any one of [1] to [9], wherein one of the tubular housing sections and other tubular housing sections each adjacent to the one of the tubular housing sections are mutually connected at outer circumferential wall surfaces thereof in the plurality of tubular housing sections.

Moreover, the container holding member according to one embodiment of the present invention can be used for the medical container set and the package product described below.

[11] A medical container set provided with: the container holding member according to any one of [1] to [10]; and a plurality of bottomed tubular medical containers housed and held in the tubular housing sections in the container holding member.

[12] The medical container set according to [11], wherein the container holding member comprising the plurality of medical containers held therein is housed in a box type container.

[13] A package product provided with: a box type container; and the container holding member according to any one of [1] to [10] housed in the box type container.

[14] The package product according to [13], wherein a plurality of bottomed tubular medical containers are housed in the tubular housing sections in the container holding member.

INDUSTRIAL APPLICABILITY

The container holding member according to the present embodiment is utilized suitably for storage, transportation, sterilization treatment, freeze-drying treatment, and the like of medical containers.

REFERENCE SIGNS LIST

1 Medical container (vial)
2 Medical container (syringe barrel)
10 Container holding member
20 Substrate section
  20*a* One surface (upper surface) of substrate section
  20*b* The other surface (lower surface) of substrate section
30 Through hole
40 Tubular housing section
  40*a* Inner circumferential wall surface
  40*b* Outer circumferential wall surface
41 Upper side opening end
42 Lower side opening end

43 Flange portion
44 Projection portion
45 Hole portion
50 Connection portion
11 Medical container set

The invention claimed is:

1. A medical container set comprising:

a container holding member; and a plurality of bottomed tubular medical containers, wherein the container holding member comprises:

a flat plate-shaped substrate section comprising: a first surface, a second surface, and a plurality of through holes each penetrating from the first surface to the second surface opposite to the first surface of the substrate section; and a plurality of tubular housing sections forming the plurality of the through holes each between an upper side opening end and a lower side opening end of the substrate section, wherein each of the plurality of the bottomed tubular medical containers is housed and held in one of the plurality of the tubular housing sections in the container holding member in a state where an outer bottom surface of the one of the medical containers protrudes downwardly from the lower side opening end of the respective tubular housing section holding the one of the medical containers, wherein a degree of the protrusion of the one of the medical containers downwardly from the lower side opening end of the tubular section is in a range of more than 0% and 25% or less of a height of the one of the medical containers, the each of the plurality of the tubular housing sections has a tubular shape that corresponds to a tubular shape of the one of the medical containers held in the plurality of the tubular housing sections, a shape of an opening of the lower side opening end is larger than a shape of an external form of the outer bottom surface of the one of the medical containers held in the respective tubular housing section and is smaller than an outer width of the one of the medical containers, the plurality of the tubular housing sections each surrounds an entire outer circumference of a portion of the one of the medical containers within the respective tubular housing section, the each of the plurality of the tubular housing sections comprises a flange portion at the lower side opening end thereof, a bottom surface of the flange portion forms part of the second surface of the flat plate-shaped substrate section, the flange portion extends from an inner circumferential wall surface of the each of the plurality of the tubular housing sections toward an inside thereof, and the flange portion of each of the plurality of the tubular housing sections holds the one of the plurality of the medical containers by contacting an outer circumferential surface of the respective medical container.

2. The medical container set according to claim 1, wherein the plurality of the bottomed tubular medical containers each comprises a rounded corner portion that has a determined radius of curvature and that is formed between the outer bottom surface and an outer circumferential surface thereof, and the flange portion contacts with the rounded corner portion of the one of the plurality of the medical containers housed and held in the respective tubular housing section.

3. The medical container set according to claim 1, wherein the flange portion of the each of the plurality of the tubular housing sections is inclined downwardly toward the inside of the each of the plurality of the tubular housing sections.

4. The medical container set according to claim 1, wherein the plurality of the tubular housing sections each has a shape such that the inside of the each of the plurality of the tubular housing sections becomes gradually narrower from the upper side opening end toward the lower side opening end.

5. The medical container set according to claim 1, wherein the plurality of the tubular housing sections each comprises a projection portion therein, at a portion of the inner circumferential wall surface of the each of the plurality of the tubular housing sections, and the projection portion projects toward the inside of the each of the plurality of the tubular housing sections.

6. The medical container set according to claim 1, wherein the plurality of the tubular housing sections each comprises a hole portion penetrating the inner circumferential wall surface and an outer circumferential wall surface thereof.

7. The medical container set according to claim 1, wherein both the plurality of the through holes and the plurality of the tubular housing sections are arranged in a staggered manner or in a lattice manner relative to the substrate section.

8. The medical container set according to claim 1, wherein a first tubular housing section as one of the plurality of the tubular housing sections and a second tubular housing section as another thereof that are adjacent to each other are mutually connected at outer circumferential wall surfaces of the first tubular housing section and the second tubular housing section.

9. The medical container set according to claim 1, wherein the container holding member comprising the plurality of the medical containers held therein is housed in a box-shaped container.

10. The medical container set according to claim 1, wherein the flange portion is formed in a circular manner along an entire circumference of the lower side opening end of each of the plurality of the tubular housing sections.

11. The medical container set according to claim 1, wherein the flange portion is formed in a circular manner along part of a circumference of the lower side opening end of each of the plurality of the tubular housing sections.

* * * * *